US011376464B2

(12) United States Patent
Bowers

(10) Patent No.: US 11,376,464 B2
(45) Date of Patent: Jul. 5, 2022

(54) WEIGHT PLATE AND LOGO RING

(71) Applicant: Power Systems (PS), LLC, Chattanooga, TN (US)

(72) Inventor: Michael Eugene Bowers, Maryville, TN (US)

(73) Assignee: POWER SYSTEMS (PS), LLC, Knoxville, TN (US)

( * ) Notice: Subject to any disclaimer, the term of this patent is extended or adjusted under 35 U.S.C. 154(b) by 0 days.

(21) Appl. No.: 16/894,244

(22) Filed: Jun. 5, 2020

(65) Prior Publication Data

US 2020/0384307 A1 Dec. 10, 2020

Related U.S. Application Data

(60) Provisional application No. 62/857,798, filed on Jun. 5, 2019.

(51) Int. Cl.

| | |
|---|---|
| ***A63B 21/072*** | (2006.01) |
| ***A63B 21/075*** | (2006.01) |
| ***A63B 71/06*** | (2006.01) |
| *G09F 23/00* | (2006.01) |

(52) U.S. Cl.

CPC ..... *A63B 21/0728* (2013.01); *A63B 21/072* (2013.01); *A63B 21/075* (2013.01); *A63B 71/0619* (2013.01); *A63B 2071/0602* (2013.01); *A63B 2071/0694* (2013.01); *G09F 23/0066* (2013.01)

(58) Field of Classification Search

CPC . A63B 21/0728; A63B 21/075; A63B 21/072; A63B 21/0722; A63B 21/0724; A63B 21/0726; A63B 71/0619; A63B 2071/0602; A63B 2071/0694; G09F 23/0066

See application file for complete search history.

(56) References Cited

U.S. PATENT DOCUMENTS

| | | | | |
|---|---|---|---|---|
| 7,922,633 | B2 * | 4/2011 | Januszek | A63B 21/0728 482/108 |
| 10,046,594 | B1 * | 8/2018 | Ferry | B32B 27/40 |
| 2005/0054496 | A1 * | 3/2005 | Harms | B44C 1/17 482/106 |
| 2006/0075910 | A1 * | 4/2006 | Cao | B41M 7/0027 101/129 |
| 2020/0360755 | A1 * | 11/2020 | Rothschild | A63B 21/0607 |

* cited by examiner

*Primary Examiner* — Megan Anderson

(74) *Attorney, Agent, or Firm* — McAndrews, Held & Malloy, Ltd.

(57) ABSTRACT

This disclosure relates to exercise weight plates that contain custom images such as color, lettering and/or logos, and more particularly to exercise weight plates having a removable ring that contains a custom image. The exercise weight plate may include a weight body having one or more recessed areas and one or more rings, each of which fits in one of the recessed areas. Each of the rings may be secured to the weight body so that it remains affixed during use.

20 Claims, 6 Drawing Sheets

WEIGHT PLATE AND LOGO RING

FIELD

This disclosure generally relates to weight plates that contain custom images such as color, lettering and/or logos, more particularly to weight plates having a removable ring that is customizable with desired color and/or images.

BACKGROUND

A variety of weight plates are known in the art for exercising, with the standard type being circular for use in free weight exercises. Many users such as gyms and schools desire weight plates that contain their own custom colors, logos and/or lettering.

Customizing methods exist for weight plates but have certain problems that make their use non-ideal. Some problems with the existing technology include (1) cost (e.g. special tooling required) and/or (2) long production time.

Currently available customizing methods can be financially and/or time prohibitive to a desired user. Thus it has presently been recognized that it would be advantageous to have a customizing method for weight plates that is quick and inexpensive as compared to the currently available technologies. It has also presently been recognized that it would be advantageous to be able to customize weight plates at or near the point of manufacture of the weight body and/or the point of use of the weight plate, in order to eliminate the need to ship the weight plates to a specific customization facility or over long distances.

Additionally, current commercially available customizing methods are usually permanent in nature. That is, once a weight plate is customized, the logo/lettering cannot be easily removed. It has presently been recognized that it is desirable to have customizable weight plates where the custom portion could be removed or changed at a later date.

SUMMARY OF THE DISCLOSURE

In one aspect, the disclosure provides an exercise weight plate comprising a weight body with one or more recessed areas therein; and one or more rings, each of which fits in one of said recessed areas, wherein one or more of said rings is customizable/customized to contain a desired image thereon, and wherein each of said rings is secured (locked) to the weight body so that it remains affixed during use.

In some embodiments, the weight plate has a first ring that fits into a recessed area on the top surface of the weight body and a second ring that fits into a recessed area on the bottom surface of the weight body In some embodiments, the one or more rings are secured to the weight body using one or more channels, having corresponding ridges that fit in the channels, allowing for a press fit. In some embodiments, for instance, each of said rings is secured to the weight body using two channels. In some embodiments, the two channels may be located on the inner and outer diameter of the ring, respectively.

In other embodiments, the one or more rings are secured to the weight body using one or more channels having corresponding ridges, allowing for a press fit between channel and ridge pairs. In further embodiments, the one or more rings are secured to the weight body using two channel and ridge pairs wherein two channels are present that have two corresponding ridges.

In further embodiments, the first of said two channel and ridge pairs is located at the inner diameter of said one or more rings and said one or more recessed areas and the second of said two channel and ridge pairs is located at the outer diameter of said one or more rings and said one or more recessed areas.

In a further additional aspect, the one or more rings may be secured to the weight body using adhesive. In some embodiments, adhesive is used in conjunction with the press fit channels and ridges. In some embodiments, the one or more rings are removable.

In other embodiments, a set of weight plates is contemplated, having multiple different weights, wherein at least one of the weight plates is a weight plate of the invention. In further embodiments, a set of weight plates is contemplated, having multiple different weights, wherein each of the weight plates is a weight plate of the invention.

In additional embodiments, a method of customizing an exercise weight plate is contemplated. The method involves providing a weight body having a top surface and a bottom surface, as least one of the top surface and the bottom surface comprising one or more recessed areas and providing a ring that fits in at least one of the recessed areas, the ring comprising a customized image and locking the ring to the weight body so that the ring remains affixed to the weight body during use.

Other aspects will be apparent to one of skill in the art upon review of the description and exemplary aspects and embodiments that follow.

BRIEF DESCRIPTION OF THE DRAWINGS

The drawings are provided to help illustrate and describe certain features of the aspects and embodiments of the disclosure. However, the claims and disclosure is not limited to the precise arrangements and instrumentalities of the features depicted in the drawings.

DETAILED DESCRIPTION

Before continuing to describe various aspects and embodiments in further detail, it is to be understood that this disclosure is not limited to specific compositions or process steps and may vary. As used in this specification and the appended claims, the singular form "a", "an" and "the" include plural referents unless the context clearly dictates otherwise.

Unless defined otherwise, all technical and scientific terms used herein have the same meaning as commonly understood by one of ordinary skill in the art to which this invention is related.

The inventors have advantageously discovered that a customizable weight plate can be created by using a weight plate body with one or more recessed areas, having rings that fit therein. The rings are removable, compact and light weight as compared to an entire weight plate. The rings are a fraction of the weight and/or thickness of the entire weight plate (usually less than 30%, in some embodiments less than 20%, in further embodiments less than 10% of the total weight and/or thickness). However, the ring is thick enough not to bend or crack on impact when the weight plate is used.

The removable rings can be manufactured at the same location as the weight plate body, or elsewhere, adding flexibility to the manufacturing which can greatly speed up the customization process (e.g. rings can be manufactured concurrent with the creation of the weight plates). If the rings are not made at the same location as the weight body, then only the removable rings—which are much lighter than a full weight plate—would need to be shipped to the assembly location.

The removable ring can be easily customized to contain a desired color, lettering and/or logo. This also allows for the addition of colors to the weight plates to reflect official standards.

The removable rings are stored as blanks and are customized as desired by users in a quick and easy process. Once customized, the ring is then secured (locked) to the weight body so that it remains affixed during use of the weights.

Weight plates are traditionally made by molding the plate into the desired shape, at the desired size/weight. The inventors have advantageously discovered that a weight plate can be created by molding in multiple pieces, as opposed to the traditional one piece. In this manner, the removable ring(s) is molded as one or more separate pieces, and the rest of the weight body is molded as another separate piece. In certain embodiments, the weight plate is molded in three pieces, two removable rings and one weight plate body.

Figure 1:
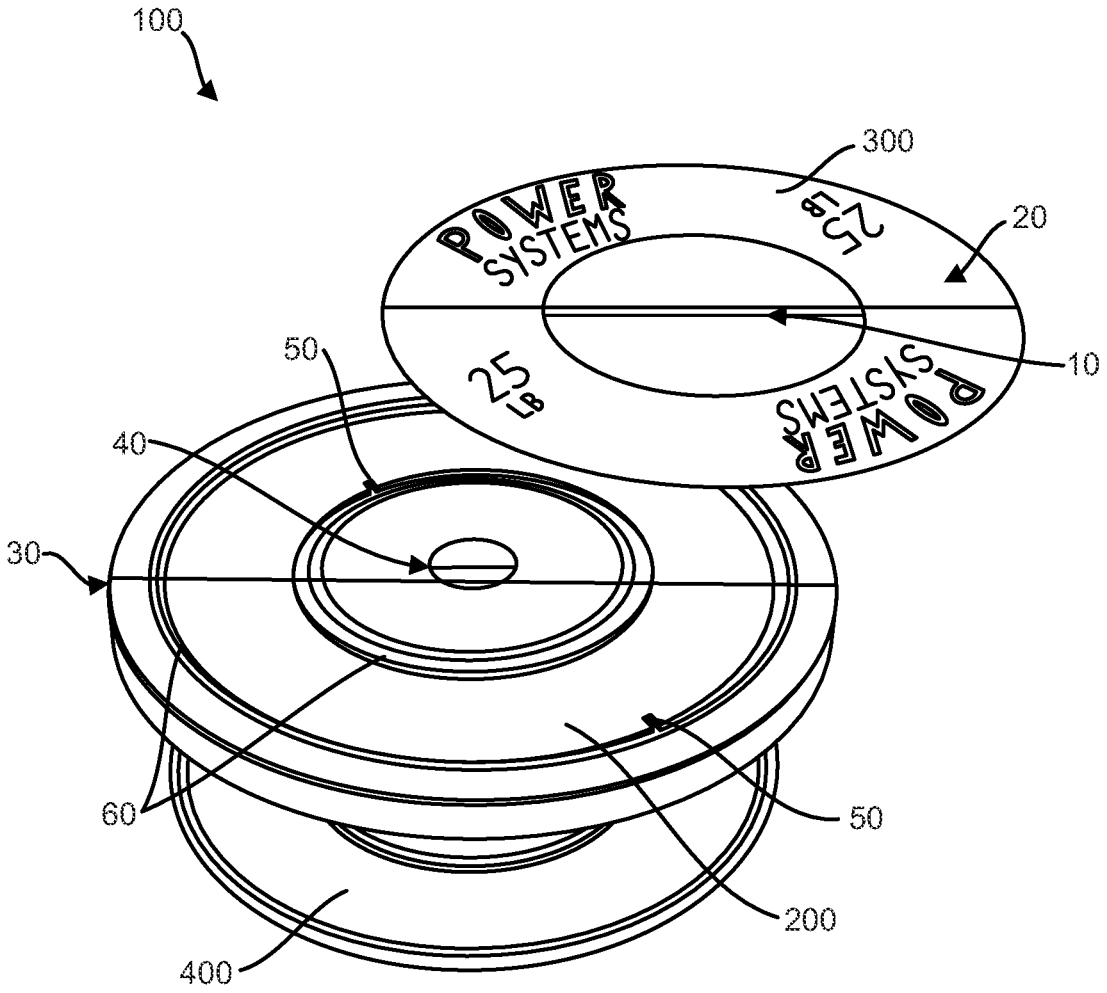
FIG. 1 shows an exemplary weight plate, having two rings that fit into recessed areas on the top and the bottom surfaces of the weight body, where each ring is secured to the weight body using two sets of tabs. Exemplary custom text and logos are shown on the removable ring.
Figure 2:
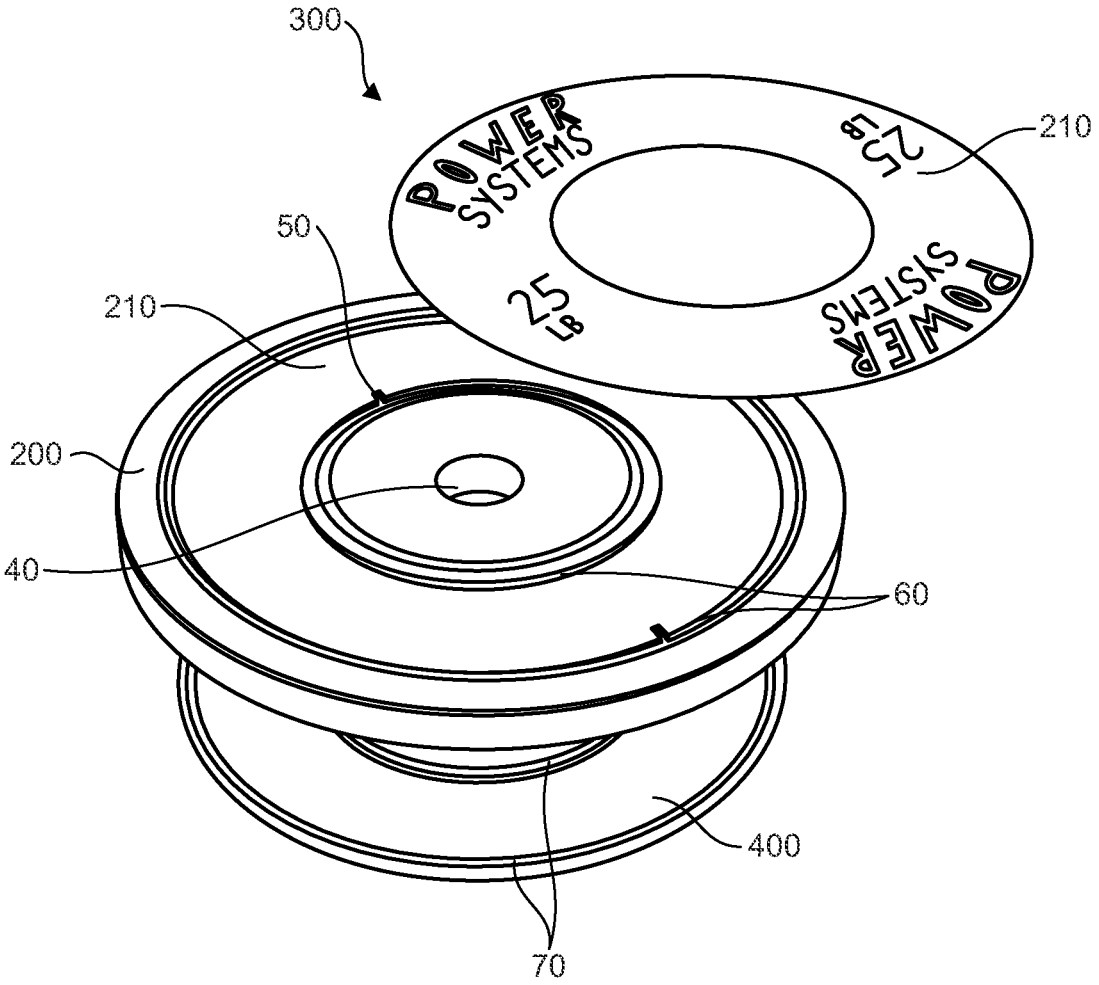
FIG. 2 shows another exemplary weight plate, having two rings that fit into recessed areas on the top and the bottom surfaces of the weight body, where each ring is secured to the weight body using two sets of tabs. Exemplary custom text, logos and color are shown on the removable ring.
Figure 3:
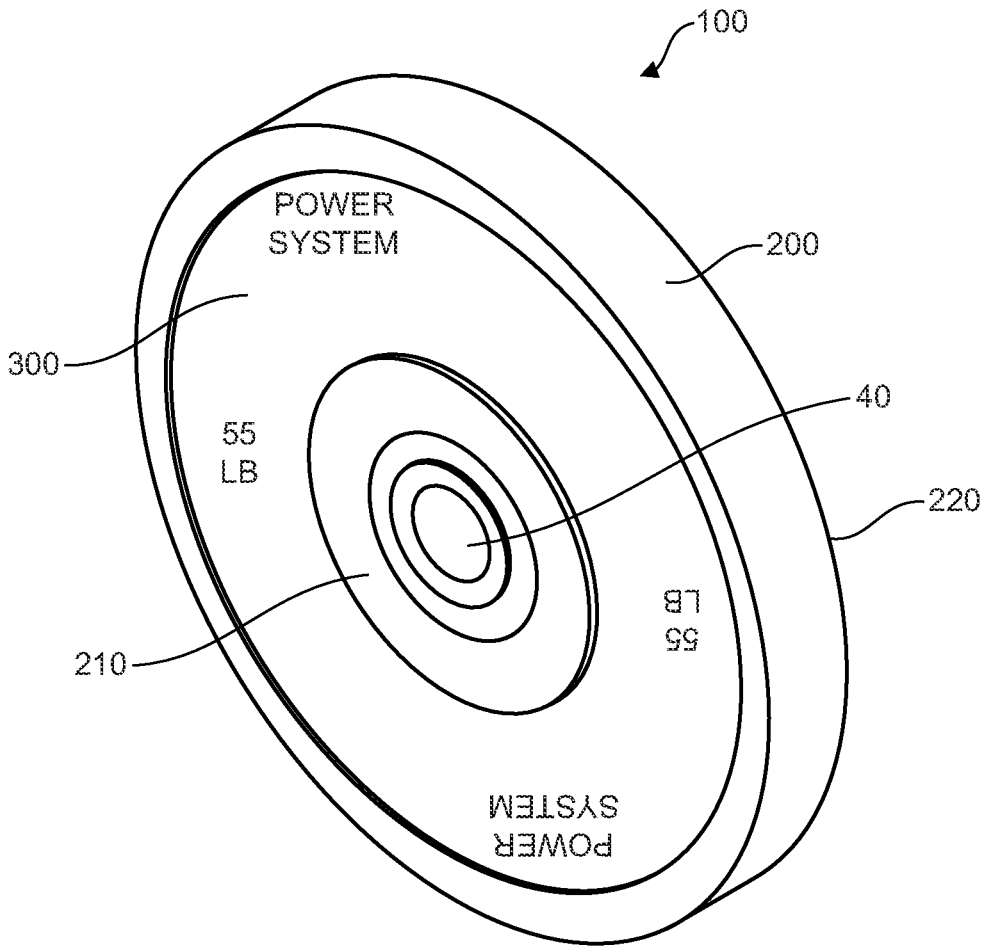
FIG. 3 shows a view of an exemplary weight plate, having a weight plate body (55 lb size) assembled with at least one ring.
Figure 4:
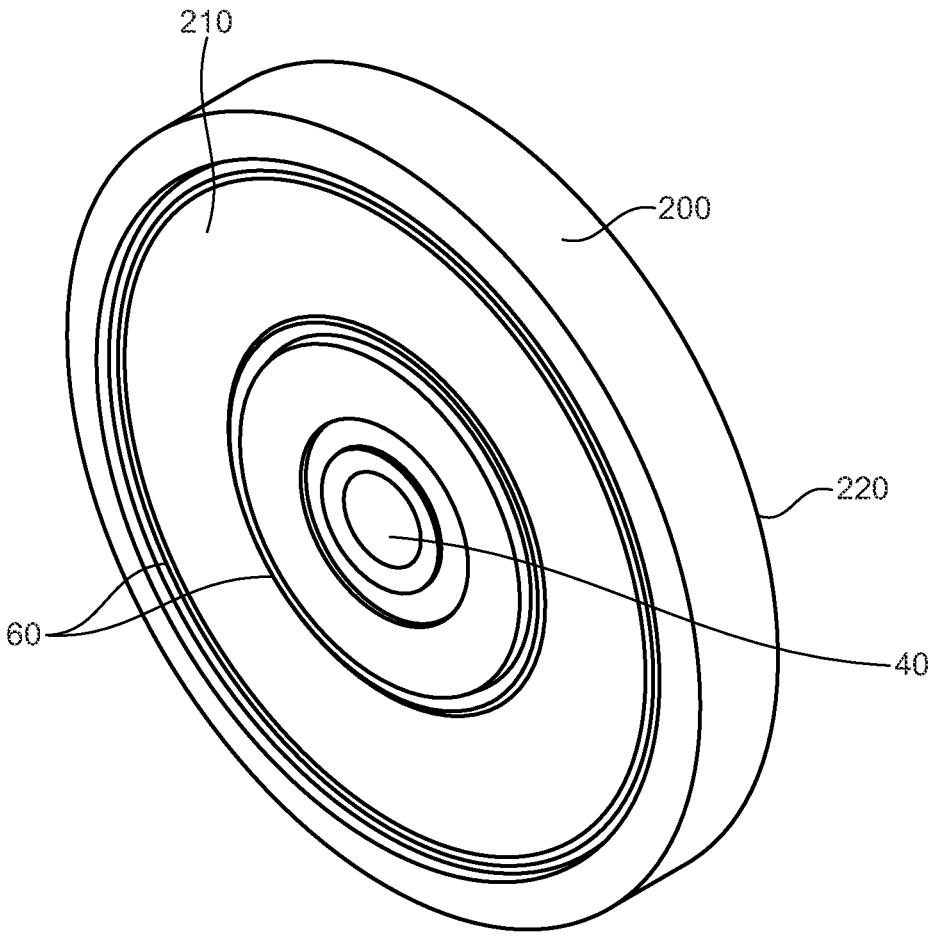
FIG. 4 shows a view of an exemplary weight plate body (55 lb size) only, illustrating the recessed area for the ring.
Figure 5:
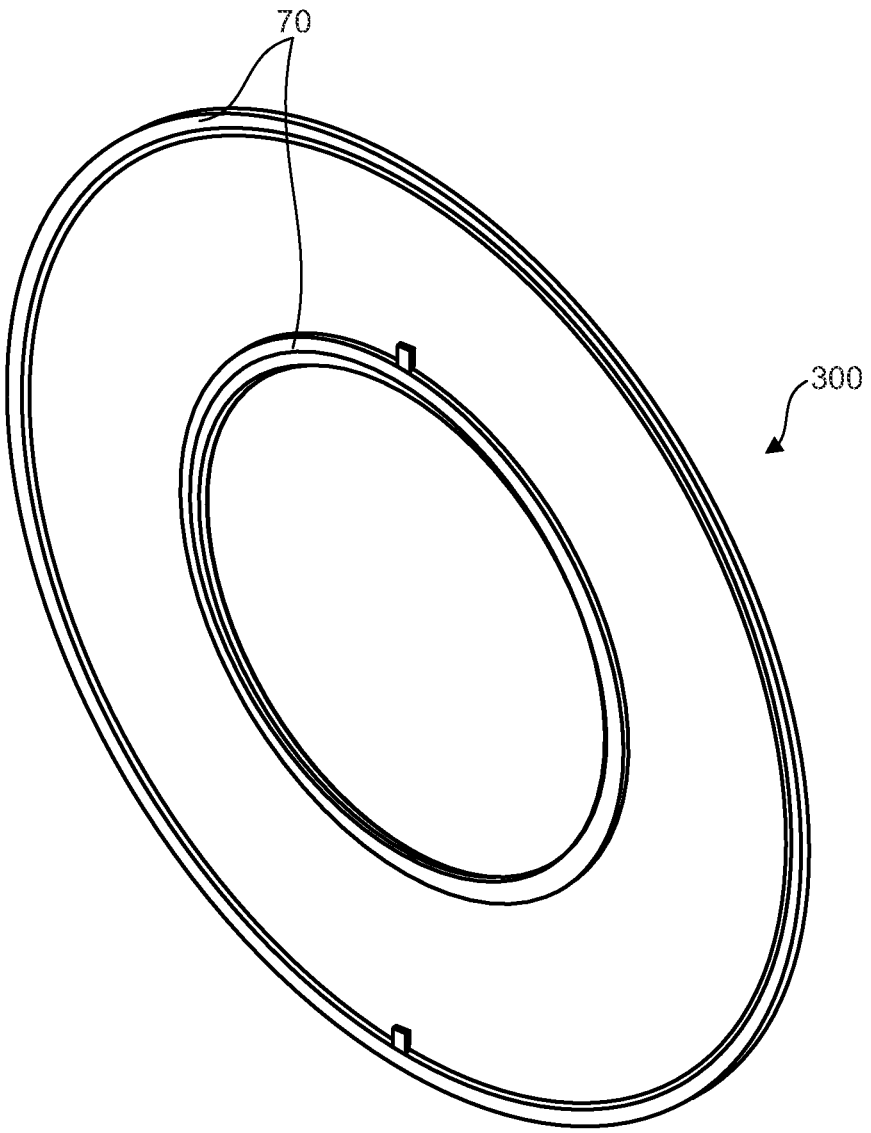
FIG. 5 shows a view of an exemplary removable ring for a 55 lb size weight plate.
Figure 6:
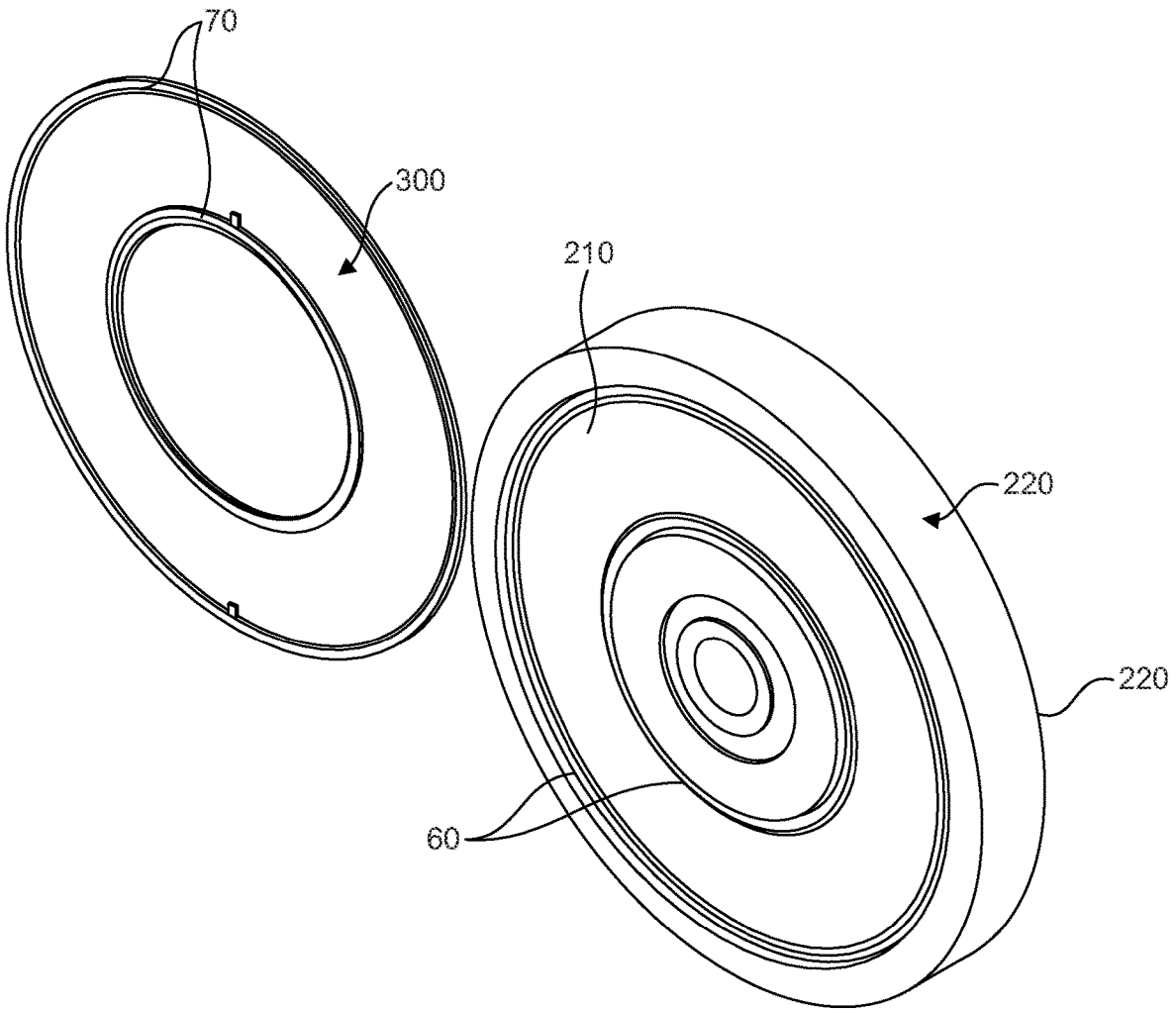
FIG. 6 shows a view of an exemplary weight plate body (55 lb size) and at least one corresponding ring, in a disassembled form.

FIG. 1 shows an exemplary weight plate 100 having a weight body 200 and two removable rings (300 and 400), a first ring 300 configured to be affixed to the top surface of the weight body 210, and a second ring 400 configured to be affixed to the bottom of the weight body 220.

Each removable ring has both an inner diameter 10 and an outer diameter 20, where the outer diameter is less than the full diameter of the weight body 30 and the inner diameter is larger than the diameter of the hole in the middle of the weight body 40 (used for placing the weight plate on a bar).

Two registration tabs (or keys) 50 are also shown. These can be a variety of sizes and shapes but serve at least in part to orientate the logo (on the ring) on the weight plate so that the logo on the front and back of the plate are aligned with each other. The registration tabs can also assist in securing or locking the ring to the weight body.

Channels 60 allowing for the press fit of the removable ring 300, 400 to the weight body 200 are shown along the circumference recessed area of the weight plate body. Channels (female) have a corresponding ridge 70 (male). Thus the ring is press fit onto the body by matching the male ridge 70 with the female channel 60. In certain embodiments, there are two channels, having corresponding ridges. These channels and ridges run along the inner and outer circumferential edges of the removable ring and along the inner and outer circumferential edges of the recessed area of the weight plate body. In another embodiment, the ridge portion of the press fit engagement is located on the ring and the female channel(s) is on the weight plate body. In further embodiments, a protrusion on the weight body provides the male portion of the engagement, which fits onto a channel located on the ring.

Other methods of securing the ring onto the weight body are contemplated. In a further embodiment, the channels 60 allow for the press fit of the removable ring 300, 400 itself into the recessed area. Thus the entire ring 300, 400 can serve as a ridge 70 that fits in to the channel 60. In additional embodiments, for instance, the press fit involves the edges of the ring being inserted into channels formed by a recessed area (e.g. a "u-shaped" channel). Thus the edges of the ring are fitted into a channel on the weight plate body so that the ring is secured within the channel along its inner or outer circumference, or both.

The weight body may be made from Nitrile rubber (NBR), urethane blends such as thermoplastic polyurethane (TPU) and casting polyurethane elastomer (CPU), and/or synthetic rubbers such as neoprene or other polymers of chloroprene. In some embodiments, the weight body is made from metal such as cast iron. In some embodiments, the weight body is made of metal that is covered with a plastic/elastic material such as neoprene or rubber.

The removable ring may be made from the same materials as the weight body; however, in some embodiments, the removable ring is made of a different material than the weight body, including, but not limited to silicone rubber. Molding the removable ring out of a different material allows for advantages such as easier moldability and lower weight. In certain embodiments, the weight plate body is made from a urethane blend, while the removable ring is made from silicone rubber.

The removable ring is customizable. The customization method involves the molding of the ring, with optionally additional laser cutting to obtain a desired shape. The customization can also include additional filling of the molded (and potentially laser cut) ring with silicone rubber or urethane, which can be additionally colored to create a desired user's logo or design.

The locking of the ring to the weight body is performed so that the ring remains affixed during use of the weight plate for exercising. In some embodiments, the ring 300 is affixed to the weight body 200 in a removable manner so that it can be changed, if desired. This allows for the user to have updated logos added, for example.

In certain embodiments, the removable ring 300, 400 is secured to the weight body 200 by one or more locking channels 60. These channels 60 provide a press fit locking mechanism between the ring 300, 400 and the weight body 200. The channels 60 can be located on the inner diameter of the weight body, the outer diameter of the weight body, or both.

The orientation of the channels and ridges can occur with female channel on weight plate body and the male ridge on the ring, or female channel on the removable ring and the male ridge on the weight plate body. Having the male ridge on the ring is advantageous for molding due to lowering the tooling cost (weight). The channels and ridges are close in size to allow for a press fit between the channels/ridges.

For example, the embodiment shown in FIG. 1 contains two channels and corresponding ridges that lock the ring in place on the weight body.

Rings attached by channels can be removable so that they could be changed to a different ring (potentially containing different customization) at a later point in time.

In other embodiments, the ring 300, 400 may be secured to the weight body 200 using an adhesive, including, but not limited to cyanoacrylate. When adhesives are used, the ring 300, 400 may or may not be removable, depending on the nature of the adhesive. When adhesive is used, it can be used alone or in conjunction with other methods of locking the ring to the weight body. In some embodiments, the ring is secured (locked) to the weight body using both press fit channels/ridges and adhesive.

The removable ring represents only a fraction of the weight of the entire plate. Thus the ring is more easily fabricated and shipped. Weight body blanks can be made in advance and the manufacturing time for the entire plate is greatly reduced as only the removable ring needs to be made at the time a product is ordered.

In additional embodiments, the removable portion of the weight plate is made in a shape other than a ring. Shapes such as crescents, squares, octagons, hexagons, triangles, half rings or arcs are also contemplated.

General dimensions of exemplary weight plates are shown in Table 1. Dimensions can vary from these values depending on the plate design and material. In some embodiments, thickness is adjusted based on the material used to make the plate.

TABLE 1

Approximate Dimensions of Example Weight Plates

| Weight (lb) | Diameter (mm) | Diameter (in) | Core | Thickness (mm) | Thickness (in) |
|---|---|---|---|---|---|
| 2.5 | 162 | 6.38 | — | 15 | 0.6 |
| 5 | 190 | 7.5 | — | 19 | 0.75 |
| 10 | 230 | 9 | — | 26 | 1.02 |
| 25 | 450 | 17.72 | 185 mm (7.3 in) | 32 | 1.25 |
| 35 | 450 | 17.72 | 185 mm (7.3 in) | 43 | 1.7 |
| 45 | 450 | 17.72 | 185 mm (7.3 in) | 55 | 2.15 |
| 55 | 450 | 17.72 | 185 mm (7.3 in) | 64 | 2.5 |

The removable rings represent a fraction of the weight of a weight plate, usually less than 30%, in some embodiments less than 20%, in further embodiments less than 10% of the total weight. The removable rings also represent a fraction of the thickness of a weight plate, usually less than 30%, in some embodiments less than 20%, in further embodiments less than 10% of the total thickness.

While specific aspects of the subject disclosure have been discussed, the above specification is illustrative and not restrictive. Many variations of the disclosure will become apparent to those skilled in the art upon review of this specification and the claims below. The full scope of the disclosure should be determined by reference to the claims, along with their full scope of equivalents, and the specification, along with such variations.

The invention claimed is:

1. An exercise weight plate comprising:

a weight body having a top surface and a bottom surface, at least one of the top surface and the bottom surface comprising a recessed areas; and one or more rings, each of which fits in at least one of the recessed areas, wherein at least one of the one or more rings contains a customized image, and wherein the one or more rings are secured to the weight body so as to remain affixed during use; and wherein each of said one or more rings is secured to the weight body by the interaction between one or more ridges and one or more channels, in which the one or more ridges are press fit into the one or more channels.

2. The exercise weight plate of claim 1, wherein the one or more ridges comprises two ridges and the one or more channels comprises two channels.

3. The exercise weight plate of claim 2, wherein a first of the two ridges is located at an inner diameter of a ring of said one or more rings; and a second of the two ridges is located at an outer diameter of the ring.

4. The exercise weight plate of claim 3, wherein the recessed area comprises the two channels, a first of the two channels being located at an inner circumference of the recessed area and a second of the two channels being located at an outer circumference of the recessed area.

5. The exercise weight plate of claim 1, wherein each of the top surface and the bottom surface of the weight body comprises a recessed area; and wherein the one or more rings comprises a first ring that fits into the recessed area on the top surface of the weight body and a second ring that fits into the recessed area on the bottom surface of the weight body.

6. A set of exercise weight plates having multiple different weights, wherein at least one of the set of exercise weight plates is an exercise weight plate according to claim 1.

7. A set of exercise weight plates having multiple different weights, wherein each of the weight plates in the set of exercise weight plates is an exercise weight plate according to claim 1.

8. An exercise weight plate comprising:

a weight body having a top surface and a bottom surface, as least one of the top surface and the bottom surface comprising a recessed area; and one or more rings, each of which fits in at least one of the recessed areas, wherein at least one of the one or more rings contains a customized image, and wherein the one or more rings are secured to the weight body so as to remain affixed during use; and wherein said one or more rings are removable.

9. The exercise weight plate of claim 8, wherein said one or more rings are secured to the weight body by an adhesive.

10. The exercise weight plate of claim 8, wherein the one or more rings are made from the same material as the weight body.

11. The exercise weight plate of claim 8, wherein the one or more rings are made from silicone rubber.

12. A method of customizing an exercise weight plate comprising:

providing a weight body having a top surface and a bottom surface, at least one of the top surface and the bottom surface comprising a recessed area; and providing one or more rings that fit in at least one of the recessed areas, the one or more rings comprising a customized image; and locking said one or more rings to the weight body so that the one or more rings remain affixed to the weight body during use; and wherein each of said one or more rings is locked to the weight body by the interaction between one or more ridges and one or more channels, in which the one or more ridges are press fit into the one or more channels.

13. The method of claim 12, wherein the one or more ridges comprises two ridges and the one or more channels comprises two channels.

14. The method of claim 13, wherein a first of the two ridges is located at an inner diameter of a ring of said one or more rings; and a second of the two ridges is located at an outer diameter of the ring.

15. The method of claim 14, wherein the recessed area comprises the two channels, a first of the two channels being located at an inner circumference of the recessed area and a second of the two channels being located at an outer circumference of the recessed area.

16. The method of claim 12, wherein each of the top surface and the bottom surface of the weight body comprises a recessed area; and wherein the one or more rings comprises a first ring that fits into the recessed area on the top surface of the weight body and a second ring that fits into the recessed area on the bottom surface of the weight body.

17. A method of customizing an exercise weight plate comprising:

providing a weight body having a top surface and a bottom surface, at least one of the top surface and the bottom surface comprising a recessed area; and providing one or more rings that fit in at least one of the recessed areas, the one or more rings comprising a customized image; and locking said one or more rings to the weight body so that the one or more rings remains affixed to the weight body during use; and wherein said one or more rings are removable.

18. The method of claim 17, wherein said one or more rings are secured to the weight body by an adhesive.

19. The method of claim 17, wherein the one or more rings are made from the same material as the weight body.

20. The method of claim 17, wherein the one or more rings are made from silicone rubber.

* * * * *